United States Patent [19]

Abe et al.

[11] 4,257,819

[45] Mar. 24, 1981

[54] METHOD FOR FLUSHING OUT A NARROW GAP

[75] Inventors: Kenji Abe, Hyogo; Ayao Tsuge; Yasuhiko Hirao, both of Kobe; Keiichi Hori, Hyogo; Masamichi Isono, Himeji, all of Japan

[73] Assignee: Mitsubishi Jukogyo Kabushiki Kaisha, Tokyo, Japan

[21] Appl. No.: 14,629

[22] Filed: Feb. 23, 1979

[30] Foreign Application Priority Data

Mar. 10, 1978 [JP] Japan ..... 53/27283

[51] Int. Cl.[3] ..... B08B 3/10; B08B 9/00

[52] U.S. Cl. ..... 134/19; 134/22 R; 134/35; 165/95

[58] Field of Search ..... 134/19, 22 R, 22 C, 134/34, 35; 165/5, 95

[56] References Cited

U.S. PATENT DOCUMENTS

| | | | |
|---|---|---|---|
| 1,804,331 | 5/1931 | Freund | 134/35 X |
| 2,123,434 | 7/1938 | Paulson et al. | 165/95 X |
| 2,622,046 | 12/1952 | Bassett | 134/35 X |
| 2,779,696 | 1/1957 | Rutherford | 134/22 C X |
| 3,234,047 | 2/1966 | Olson | 134/35 X |
| 3,948,679 | 4/1976 | Lewis | 134/22 C X |

*Primary Examiner*—Marc L. Caroff

*Attorney, Agent, or Firm*—Wenderoth, Lind & Ponack

[57] ABSTRACT

Difficult flushing of a very narrow gap between a first member having a bore with a closed end and a second member inserted and fixed in the bore can be easily achieved by connecting the gap with a container filled with a pressurized flushing liquid and locally heating the closed end of the gap. Preferably, while locally heating the blocked end of the gap the pressure of the pressurized liquid is reduced to cause the liquid to boil, and if necessary, the pressurizing and pressure reduction are repeated to enhance the flushing effect.

2 Claims, 2 Drawing Figures

METHOD FOR FLUSHING OUT A NARROW GAP

Figure 1:
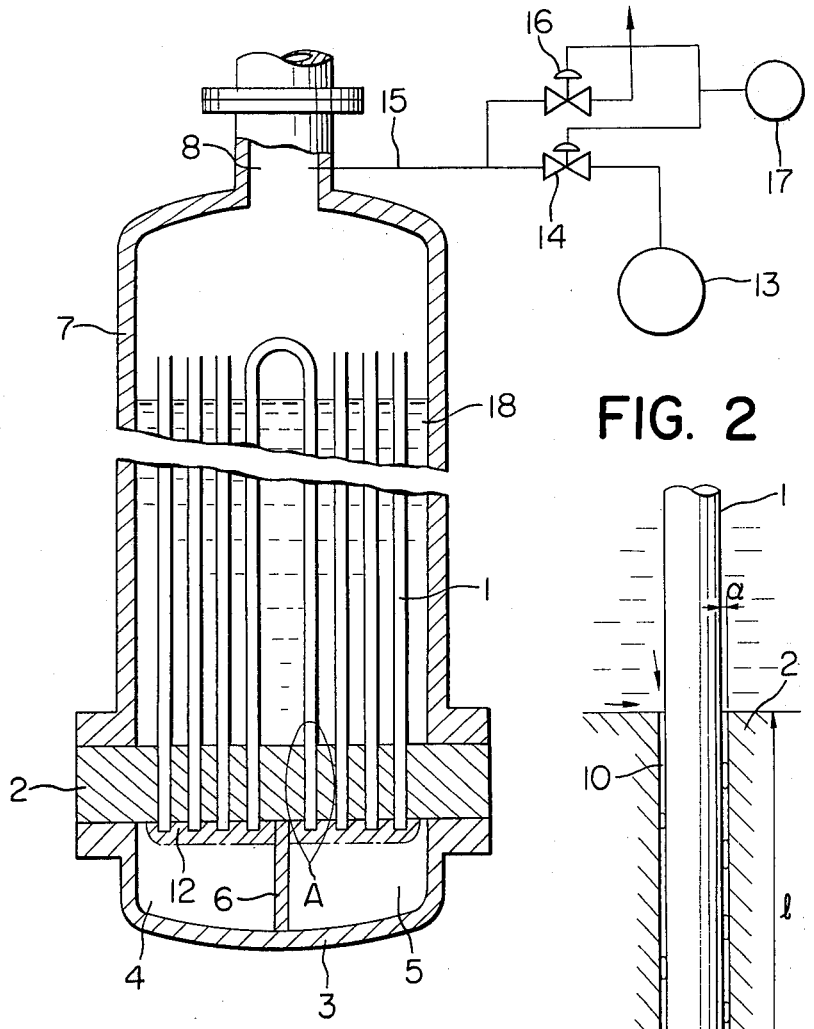

The present invention relates to a method for flushing a very narrow gap, and especially, a very narrow deep gap having one end closed.

In various instruments and apparatuses, at least two members connected to each other often form a gap space therebetween, and during normal use of these instruments or the like, micro-fine material often enters the gap. If such material causes corrosion of the members and is thus harmful for the members, it is necessary to remove the material periodically for keeping the interior of the gap clean.

However, where the gap is very narrow and its opening is small, removal of the harmful material, such as by a flushing operation, is difficult.

For instance, in a shell-and-tube heat exchanger, an end portion of a heat transfer tube is inserted into a bore in a thick tube plate and sealingly fixed thereto. Generally, the sealed fixing between a heat transfer tube and a tube plate is achieved by expanding or welding the end of the tube, and hence a very narrow deep gap is formed between the heat transfer tube and the tube plate.

On the other hand, under normal operating conditions various chemicals are mixed in the fluid flowing around the outside of said heat transfer tube (normally a secondary fluid, which is water in the case of a steam generator or the like) to serve as rust preventives or boiler flushing agents.

Thus these chemicals enter the gap, and collect and are concentrated therein, or sludge and the like produced by the flow of the fluid enters and stagnates therein.

Since the heat transfer tube is normally very thin to improve heat exchanging efficiency or the like, accidents of breaking such as the heat transfer tubes may occur due to corrosive action of the concentrated chemicals, sludge or the like within the gap.

In a heat exchanger in which the mixing of a primary fluid flowing through the heat transfer tube with a secondary fluid flowing through a drum (outside of the heat transfer tube) is extremely unfavorable (a steam generator in a PWR type atomic power plant which requires that the primary coolant water be completely prevented from leaking into secondary water, being one example), in order to prevent breaking of a heat transfer tube caused by the corrosive action, it is necessary to flush the interior of the gap and to keep it clean, but a method and an apparatus which are satisfactory from the standpoint of working time and expense have not been developed thus far.

Therefore, it is one object of the present invention to provide a method for efficiently flushing harmful materials from the aforementioned type of gap within a short period of time.

According to one feature of the present invention, there is provided a method for flushing a very narrow gap formed between a first member having a bore having a closed end and a second member inserted and fixed in said bore, including the steps of connecting said gap with a container filled with a flushing liquid, pressurizing said flushing liquid, and locally heating the closed end of said gap.

According to another feature of the present invention, there is provided a method for flushing a very narrow gap formed between a first member having a bore with a closed end and a second member inserted and fixed in said bore, including the steps of connecting said gap with a container filled with a flushing liquid, pressurizing the flushing liquid, locally heating the closed end of said gap, and then reducing the pressure of said pressurized flushing liquid.

According to still another feature of the present invention, there is provided the above-described method for flushing a very narrow gap formed between a first member having a bore with a closed end and a second member inserted and fixed in said bore, in which while locally heating the closed end of said gap, the steps of pressurizing said flushing liquid and reducing the pressure of said pressurized flushing liquid are alternately repeated to enhance the flushing effect.

The apparatus for flushing a very narrow gap formed between a first member having a bore with a closed end and a second member inserted and fixed in bore said according to the method of the invention, comprises a container accomodating a flushing liquid and adapted to communicate with said gap, means for locally heating the closed end of said gap, means coupled to said container for pressurizing said flushing liquid, and means for circulating said flushing liquid.

In the above-described method according to the present invention, since the flushing liquid is caused to enter the very narrow gap containing chemicals or sludge which cause harmful effects such as corrosion or the like and the closed end of the gap is heated, the temperature of the flushing liquid in the very narrow gap is caused to rise so as to generate vapor bubbles, the expansion and escape of the vapor bubbles of the flushing liquid pushes the accumulated foreign matter out of the gap and causes replacing of the flushing liquid by fresh clean flushing liquid, so that the interior of the very narrow gap is flushed efficiently.

In the above-described method according to the present invention, by the additional step of reducing the pressure of the pressurized flushing liquid the above-described behavior of the flushing liquid in the gap is promoted and the position of vapor bubble generation in the gap moves from the deep part of the gap toward the opening, so that not only can the flushing of the gap can be achieved more completely within a shorter period of time, but also the amount of heat energy needed can be reduced and hence the cost of flushing can be greatly reduced.

Furthermore, the above-described is very suitable for efficiently practicing the method according to the present invention.

Figure 2:
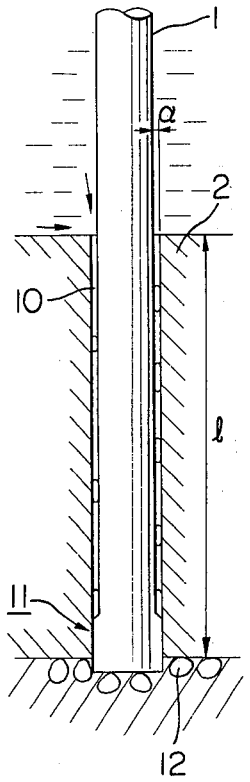

The foregoing and other features and objects of the present invention will become more apparent by reference to the following description of its preferred embodiments taken in conjunction with the accompanying drawings, in which:

FIG. 1 is a schematic sectional side view partly cut away of a steam generator having U-shaped heat transfer tubes, with a schematic diagram of an apparatus for flushing very narrow gap formed between said heat transfer tubes and a tube plate in said steam generator, and FIG. 2 is an enlarged sectional side view of the portion encircled by line A in FIG. 1.

Referring now to FIG. 1 of the drawings, opposite ends of a plurality of vertically extending U-shaped heat transfer tubes 1 are inserted into bores provided in a tube plate 2 and open into water chambers 4 and 5 formed between the tube plate 2 and an end plate 3.

The water chambers 4 and 5 are partitioned by a shielding plate 6, and communicate with an inlet and an outlet, respectively, for primary liquid not shown.

A shell 7 having an inlet not shown for secondary liquid, for example feed water, has the bottom end fixedly secured to the tube plate 2 in a water-tight manner, and the shell 7 surrounds the heat transfer tubes 1. In addition, the shell 7 is provided with an outlet 8 for steam at its top end. The outlet 8 of the shell 7 is normally connected to a turbine not shown, but during a flushing operation as described later it is sealed off by means of a closure member not shown.

The structural relation of the heat transfer tube 1 and the tube plate 2 is illustrated on an enlarged scale in FIG. 2, in which the end portion 11 of the heat transfer tube 1 is shown as being expanded and sealingly secured to the tube plate 2.

Between the tube plate 2 and the heat transfer tube 1 is formed a very narrow gap 10.

The ratio between the thickness l of the tube plate 2 and the gap width d, i.e. the ratio l/d, often amounts to about 2000. On the lower side of the tube plate 2 is provided a heating device 12 adjacent to the end portions 11 of the heat transfer tubes 1.

To the outlet 8 of the shell 7 is connected pressurizing means, e.g. an air compressor 13, through a conduit 15 including a switching valve 14. The conduit 15 is connected to the atmosphere via an exhaust valve 16, and the exhaust valve 16 and switching valve 14 are coupled to a switching control device 17.

The primary liquid within the heat transfer tube 1 and the water chambers 4 and 5 and the feed water (secondary liquid) within the shell 7 can be completely removed, but the liquid trapped within the gap 10 cannot be removed and remains therein.

To carry out flushing, in place of the feed water containing rust protectives and the like, a predetermined amount of clean water 18 containing no harmful materials such as, for example, pure water is charged into the shell 7. While clean water 18 is employed in the illustrated embodiment, it is also possible that a flushing liquid such as an organic solvent could be used so long as it does not cause harmful effects such as corrosion.

In this preferred embodiment, in order to flush the interior of the gap 10, the clean water 18 charged into the shell 7 in place of the feed water is pressurized up to a predetermined pressure such as, for example, 3 atm. by the air compressor 13 by opening the switching valve 14. During this pressurizing operation, the exhaust valve 16 is closed.

As a result of the above-described pressurizing operation, the clean water 18 enters the gap 10. As a result, the interior of the gap 10 is filled with condensed rust protectives or boiler flushing agent (hereinafter called simply "concentrate"), sludge or the like which has migrated into the gap 10 during the boiler operation and the above-described clean water 18.

While the above-described pressure is maintained, the heating device 12 is actuated to heat the closed bottom of the gap 10.

Since the above heating is effected locally at the bottom portion of the gap 10, as is well known, the liquid temperature within the gap will be highest at the bottom portion and the temperature will be lower at the higher portions.

As the temperature within the gap 10 rises, the liquid within the gap 10 will expand in volume, and will partly flow out of the top end opening of the gap 10 at the top of the tube plate 2. Then the concentrate will diffuse in the clean water 18. As the heating is continued, the liquid at the bottom of the gap 10 reaches a saturation temperature corresponding to a saturation pressure of 3 atm., and it begins to boil. An amount of liquid including the concentrate in the upper portion of the gap 10 is pushed out of the gap 10 corresponding to the volume of the generated steam bubbles similarly to the above-described outflow of the liquid, and the condensate will diffuse in the clean water 18.

In addition, since the steam bubbles rise, a flow is generated in association with the steam bubbles, and thereby the concentrate, sludge and the like are discharged from the gap 10, and disperse in the clean water 18.

As the above-described steam bubbles go out of the gap 10, an equivalent amount of clean water 18 enters the gap 10, and the concentrate and sludge are diluted thereby.

In this way, as the heating is continued, the interior of the gap is flushed. Although the amount of the clean water 18 should preferably be such that even if the concentrate within the gap is completely exhausted the resultant impurity concentration in the clean water will be negligibly low, where a sufficient amount of clean water cannot be charged at one time into the shell 7, the above-described result can be achieved by partly replacing the clean water 18 by a fresh clean water by means of a water feed/exhaust device not shown or by circulating the clean water 18 through impurity removing means such as a filter or an ion-exchange resin layer to enhance the diffusion speed.

In addition, even if the amount of the clean water 18 is ample, the clean water 18 can be circulated within the shell 7 by means of a circulating device not shown to promote the aforementioned diffusion.

Furthermore, in order to efficiently achieve the flushing of the interior of the gap 10 by means of the apparatus illustrated in FIG. 1, the liquid temperature at the bottom of the gap 10 is raised to a predetermined temperature such as, for example, 120° C. by the above-described heating, and thereafter the compressed air within the upper portion of the shell 7 is discharged to the atmosphere by opening the exhaust valve 16 under control of the switching control device 17, and thereby the pressure within the shell 7, that is the pressure of the clean water 18, is lowered. Owing to this pressure-reducing operation, the pressure of the concentrate within the gap is lowered, and since the saturation pressure for the temperature of 120° C. is 2 atm., when the pressure is lowered to that value, boiling will begin at the bottom of the interior of the gap 10 and steam bubbles are generated.

If the pressure is further lowered, the position where the concentrate reaches a boiling point will be displaced upwards within the gap 10.

The aforementioned outflow action caused by volume expansion of the clean water and generation of the steam bubbles, inflow of the clean water accompanying the rise of the steam bubbles for replacing the outflowing concentrate caused by escape of the steam bubbles, and activation of the flow caused by displacement of the boiling position all jointly serve to promote the flushing action in the interior of the gap 10. Still further, by alternately repeating the above-described pressurizing and pressure reduction, by alternately opening and closing the switching valve 14 and the exhaust valve 16 under control of the switching control device 17, the interior of the gap 10 can be efficiently flushed within an extremely short period of time.

While the illustrated embodiment is directed to a vertical type steam generator, even in a horizontal type steam generator (in which heat transfer tubes extend substantially in the horizontal direction and the tube plate extends in the vertical direction) the method of flushing according to the present invention is equally effective, because within the gap formed between the heat transfer tube and the tube plate, the temperature rise and generation of steam bubbles caused by heating will result in volume expansion effects.

In the above-described embodiment, since the interior of a gap 10 formed between a heat transfer tube and a tube plate in a heat exchanger is intended to be flushed, the shell 7 of the heat exchanger is used as a container for accommodating clean water 18. However, in order to flush a gap formed in an apparatus not provided with such a container, it is only necessary to accommodate a flushing liquid such as a clean water within a separately provided container.

While the present invention has been described above in connection with one preferred embodiment thereof, it is intended that all the matter described in the specification and illustrated in the drawings shall be interpreted as being illustrative and not in a limiting sense.

What is claimed is:

1. A method of flushing a gap between a bore in a tube plate of a shell-and-tube type boiler and a heat transfer tube positioned in said bore and expanded against the plate so as to be secured in the bottom of the bore and to close the bottom of the bore and to define the gap between the tube plate and the heat transfer tube, said gap having a closed end at the bottom of the bore and an open end where said bore opens out of said tube plate, the shell of the boiler being over the surface of the tube plate out of which said gap opens, said method comprising filling a predetermined amount of flushing liquid into said shell, increasing the pressure of said flushing liquid by increasing the pressure within said shell, locally heating said tube plate at the closed end of the bore to a temperature which, when the pressure of the flushing liquid is subsequently reduced, is sufficient to cause boiling of the flushing liquid, and then reducing the pressure in said shell to cause boiling of the liquid within the gap for flushing the gap by causing some of the liquid to be flushed out of the gap and the liquid flushed out of the gap is replaced by flushing liquid, and while continuing to locally heat the tube plate at the closed end of the bore, repeating the steps of alternately increasing the pressure of and reducing the pressure of said flushing liquid, whereby the flushing efficiency is enhanced.

2. A method for flushing a very narrow gap formed between a first member having a bore with a closed end and a second member fixed in said bore to define a gap between the second member and the surface of the first member defining the bore, said gap having a closed end at the closed end of said bore and an open end where said bore opens out of said first member, said method comprising the steps of placing the open end of said gap in communication with a space filled with a flushing liquid, increasing the pressure of said flushing liquid, locally heating the closed end of said gap to a temperature which, when the pressure of the flushing liquid is subsequently reduced is sufficient to cause boiling of the flushing liquid, and then reducing the pressure of pressurized flushing liquid to cause boiling of the liquid within the gap for flushing the gap by causing some of the liquid to be flushed out of the gap and the liquid flushed out of the gap is replaced by flushing liquid, and while continuing to locally heat the closed end of said gap, repeating the steps of alternately increasing the pressure of and reducing the pressure of said flushing liquid, whereby the flushing efficiency is enhanced.

* * * * *